US007026889B2

(12) United States Patent
Sledkov

(10) Patent No.: US 7,026,889 B2
(45) Date of Patent: Apr. 11, 2006

(54) ADJUSTABLE ANTENNA FEED NETWORK WITH INTEGRATED PHASE SHIFTER

(75) Inventor: Victor Aleksandrovich Sledkov, Wellington (NZ)

(73) Assignee: Andrew Corporation, Orland Park, IL (US)

( * ) Notice: Subject to any disclaimer, the term of this patent is extended or adjusted under 35 U.S.C. 154(b) by 59 days.

(21) Appl. No.: 10/487,819

(22) PCT Filed: Aug. 23, 2002

(86) PCT No.: PCT/NZ02/00164

§ 371 (c)(1),
(2), (4) Date: Feb. 19, 2004

(87) PCT Pub. No.: WO03/019723

PCT Pub. Date: Mar. 6, 2003

(65) Prior Publication Data

US 2004/0239444 A1 Dec. 2, 2004

(30) Foreign Application Priority Data

Aug. 24, 2001 (NZ) ..... 513770

(51) Int. Cl.
*H01P 5/12* (2006.01)
*H01P 1/18* (2006.01)

(52) U.S. Cl. ..... 333/128; 333/156; 333/159; 333/161; 342/375; 343/853

(58) Field of Classification Search ..... 333/124, 333/125, 127, 128, 136, 156, 159, 161; 342/375; 343/853

See application file for complete search history.

(56) References Cited

U.S. PATENT DOCUMENTS

| | | | | |
|---|---|---|---|---|
| 2,831,169 | A | 4/1958 | Casal | 333/160 |
| 3,440,573 | A | 4/1969 | Butler | 333/161 |
| 3,656,179 | A | 4/1972 | De Loach | 333/161 |
| 4,356,462 | A | 10/1982 | Bowman | 333/128 |
| 4,691,208 | A | 9/1987 | Stern et al. | 343/785 |
| 4,814,657 | A * | 3/1989 | Yano et al. | 310/309 |
| 5,087,922 | A | 2/1992 | Tang et al. | 343/814 |
| 5,126,705 | A | 6/1992 | Carnevali et al. | 333/128 |
| 5,220,335 | A | 6/1993 | Huang | 343/700 MS |
| 5,504,466 | A * | 4/1996 | Chan-Son-Lint et al. | 333/159 |
| 5,557,286 | A | 9/1996 | Varadan et al. | 343/700 MS |
| 5,798,675 | A * | 8/1998 | Drach | 333/161 |

(Continued)

FOREIGN PATENT DOCUMENTS

DE 29 47 987 A1 9/1981

(Continued)

*Primary Examiner*—Barbara Summons
(74) *Attorney, Agent, or Firm*—Welsh & Katz, Ltd.

(57) ABSTRACT

A device for feeding signals between a common line and two or more ports. The device including a branched network of feedlines coupling the common line with the ports. The feedlines have transformer portions of varying width for reducing reflection of signals passing through the network. A dielectric member is mounted adjacent to the network and can be moved to synchronously adjust the phase relationship between the common line and one or more of the ports. The dielectric member also has transformer portions for reducing reflection of signals passing through the network. At least one of the junctions of the network does not overlap with the dielectric member, or overlaps a region of reduced permittivity.

30 Claims, 10 Drawing Sheets

U.S. PATENT DOCUMENTS

| | | | | |
|---|---|---|---|---|
| 5,818,397 | A | 10/1998 | Yarsunnas et al. | 343/797 |
| 5,905,462 | A * | 5/1999 | Hampel et al. | 342/372 |
| 5,940,030 | A | 8/1999 | Hampel et al. | 342/372 |
| 5,949,303 | A | 9/1999 | Arvidsson et al. | 333/136 |
| 6,075,424 | A | 6/2000 | Hampel et al. | 333/161 |
| 6,441,700 | B1 * | 8/2002 | Xu | 333/161 |
| 6,717,555 | B1 * | 4/2004 | Teillet et al. | 343/797 |
| 6,816,668 | B1 * | 11/2004 | McDonald et al. | 392/375 |

FOREIGN PATENT DOCUMENTS

| | | | |
|---|---|---|---|
| DE | 31 13452 | A1 | 11/1982 |
| EP | 0 860 890 | A1 | 8/1998 |
| EP | 0 618 639 | B1 | 8/1999 |
| JP | 59117301 | | 7/1984 |
| JP | 59117801 | | 7/1984 |
| WO | WO 96/37922 | | 11/1996 |
| WO | WO 01/84661 | A1 | 11/2001 |
| WO | WO 02/35651 | A1 | 5/2002 |

* cited by examiner

Prior Art

*(section AA)*

*(section BB)*

ADJUSTABLE ANTENNA FEED NETWORK WITH INTEGRATED PHASE SHIFTER

FIELD OF INVENTION

The invention relates to a device for feeding signals between a common line and two or more ports. The invention also relates to a dielectric phase shifter and a method of manufacturing a dielectric phase shifter.

BACKGROUND OF THE INVENTION

Traditionally tuneable antenna elements consist of power splitters, transformers, and phase shifters cascaded in the antenna arrangement. In high performance antennas these components strongly interact with each other, sometimes making a desirable beam shape unrealisable.

A number of canonical beam-forming networks have been proposed in the past, to address these problems.

FIG. 1 is a plan view of part of a phase shifter described in U.S. Pat. No. 5,949,303. An input terminal 100 is coupled to an input feedline 101. A feedline 102 branches off from junction 103 and leads to a first output terminal 104. A second output terminal 105 is coupled to feedline 102 at junction 110 by a meander-shaped loop 106. A dielectric slab 107 partially covers feedline 102 and loop 106 and is movable along the length of the feedline 102 and over loop 106.

The leading edge 108 of the slab 107 is formed with a step-like recess 109, as shown in FIG. 2. The step-like recess 109 is dimensioned to minimize reflection of the radio wave energy propagating along the feedlines.

This arrangement suffers from several shortcomings.

Firstly, recess 109 of the moveable dielectric body 107 operates like a transformer increasing wave impedance in the direction from input terminal 100 to the output terminals. In order to have equal impedance at the input and all outputs, the device shown in U.S. Pat. No. 5,949,303 requires additional transformers between junction 110 and output terminal 104.

Secondly, all feedlines apart from 101, which is the first from input terminal 100, cross the edge of the dielectric plate twice. Therefore the reflection at two recesses can add up to double the reflection at one recess depending on the position of the dielectric plate.

Thirdly, the relative positions of the output terminals impose constraints on the layout, which may be incompatible with physical realisations of beam-forming networks for some applications.

Fourthly, it can be difficult to accurately and consistently fabricate the recess 109 in slab 107.

Fifthly, this approach is not suitable for a linear array containing an odd number of output ports.

SUMMARY OF THE INVENTION

It is an object of the present invention to address one or more of these shortcomings of the prior art, or at least to provide a useful alternative.

A first aspect of the invention provides a device for feeding signals between a common line and two or more ports, the device including a branched network of feedlines coupling the common line with the ports, at least one of the feedlines having a transformer portion of varying width for reducing reflection of signals passing through the network; and a dielectric member mounted adjacent to the network which can be moved along the length of at least one of the feedlines to synchronously adjust the phase relationship between the common line and one or more of the ports, the dielectric member having one or more transformer portions for reducing reflection of signals passing through the network.

The first aspect of the invention provides a means for integrating two types of transformer into the same device. As a result the wave impedance at the common line can be better matched to the wave impedance at the ports, whilst maintaining a relatively compact design.

Typically the feedline transformer portion includes a step change in the width of the feedline.

The transformer portion in the dielectric member may be provided by a recess in the edge of the member, as shown in FIG. 2. However, in the preferred embodiments described below, the transformer portion is provided in the form of a space or region of reduced permittivity.

A second aspect of the invention provides a device for feeding signals between a common line and two or more ports, the device including a branched network of feedlines coupling the common line with the ports via one or more junctions; the one or more junctions including a main junction which includes the common line; and a dielectric member mounted adjacent to the network which can be moved along the length of at least one of the feedlines to synchronously adjust the phase relationship between the common line and one or more of the ports, wherein the main junction does not overlap with the dielectric member The second aspect of the invention provides an alternative arrangement to the arrangement of FIG. 1. In contrast to the system of FIG. 1 (in which the dielectric member overlaps the junction 103), the dielectric member does not overlap with the junction. This may be achieved by forming a space in the dielectric member.

A third aspect of the invention provides a device for feeding signals between a common line and two or more ports, the device including a branched network of feedlines coupling the common line with the ports via one or more junctions; and a dielectric member mounted adjacent to the network which can be moved to synchronously adjust the phase relationship between the common line and one or more of the ports, wherein the dielectric member has a first region of relatively high permittivity, and a second region of relatively low permittivity which overlaps with at least one of the junctions.

The third aspect provides similar advantages to the second aspect.

Typically the dielectric member is formed with a transformer portion for reducing reflection of signals passing the leading or trailing edge of the space or region of reduced permittivity. In contrast to the arrangement of FIG. 1, the wave impedance at the transformer portion can decrease in the direction of the ports.

A variety of transformer portions may be used. For instance the leading and/or trailing edges of the space or region of reduced permittivity may be formed as shown in FIG. 2. However in a preferred embodiment the dielectric member is formed with at least one second space or region of relatively low permittivity adjacent to an edge of the first space or region, wherein the or each second space or region is relatively short compared to the first space or region in the direction of movement of the dielectric member, and wherein the position and size of the or each second space or region are selected such that the or each second space or region acts as an impedance transformer.

A fourth aspect of the invention provides a device for feeding signals between a common line and two or more ports, the device including a branched network of feedlines coupling the common line with the ports; and a dielectric member mounted adjacent to the network which can be moved to adjust the phase relationship between the common line and one or more of the ports, wherein the dielectric member is formed with a first space or region of relatively low permittivity, and at least one second space or region of relatively low permittivity adjacent to and spaced from an edge of the first space or region, wherein the or each second space or region is relatively short compared to the first space or region in the direction of movement of the dielectric member, and wherein the position and size of the or each second space or region are selected such that the or each second space or region acts as an impedance transformer.

The fourth aspect of the invention relates to a preferred form of transformer, which is easier to fabricate than the transformer of FIG. 2. The transformer is also easier to tune according to the requirements of the feed network (by selecting the position and size of the second space or region).

A fifth aspect of the invention provides a device for feeding signals between a common line and an array of ports, the array of ports including a central port and two or more phase shift ports, the device including a branched network of feedlines coupling the common line with the array of ports; and a dielectric member mounted adjacent to the network which can be moved to synchronously adjust the phase relationship between the common line and the two or more phase shift ports whilst maintaining a constant phase relationship between the common line and the central port.

The following comments relate to the devices according to the first, second, third, fourth and fifth aspects of the invention.

Typically the device includes a first ground plane positioned on one side of the network. More preferably the device also has a second ground plane positioned on an opposite side of the network.

Typically the feedlines are strip feedlines.

The dielectric member may be formed by joining together a number of dielectric bodies. However preferably the dielectric member is formed as a unitary piece.

Typically the dielectric member is elongate (for instance in the form of a rectangular bar) and movable along its length in a direction parallel to an adjacent feedline.

Typically the device has three or more ports arranged along a substantially straight line.

A variety of delay structures, such as meanders or stubs, may be formed in the feedlines.

A sixth aspect of the invention provides a method of manufacturing a dielectric phase shifter, the method including the step of removing material from an elongate dielectric member to form a space at an intermediate position along its length.

The sixth aspect of the invention provides a preferred method of manufacturing a dielectric member, which can be utilised in the device of the second, third or fourth aspects of the invention, or any other device in which such a design is useful. The space may be left free, or may be subsequently filled with a solid material having a different (typically lower) permittivity to the removed material. This provides a more rigid structure.

The space may be an open space (for instance in the form of a rectangular cut-out) formed in a side of the dielectric member. Alternatively the space may be a closed space (for instance in the form of a rectangular hole) formed in the interior of the dielectric member.

The member can then be mounted adjacent to a feedline with its length aligned with the feedline, whereby the dielectric member can be moved along the length of the feedline to adjust a degree of overlap between the feedline and the dielectric member.

Typically the feedline is part of a branched network of feedlines coupling a common line with two or more ports. Typically the space or region of relatively low permittivity overlaps with a junction of the branched network.

A seventh aspect of the invention provides a dielectric phase shifter comprising an elongate dielectric member formed with a space at an intermediate position along the length of the elongate member.

For instance a notch or recess may be formed in a side of the member, or a hole formed in the interior of the member.

An eighth aspect of the invention provides a dielectric phase shifter device including an elongate dielectric member formed with a space or region of relatively low permittivity at an intermediate position along the length of the elongate member, wherein the space or region is formed in a side of the dielectric member.

A ninth aspect of the invention provides a dielectric phase shifter device including an elongate dielectric member formed with a space or region of relatively low permittivity at an intermediate position along the length of the elongate member, wherein the space or region is formed in the interior of the dielectric member.

A tenth aspect of the invention provides a device for feeding signals between a common line and two or more ports. The device includes a branched network of feedlines coupling the common line with the ports via one or more junctions, the one or more junctions include a main junction, which includes the common line. Also included is a dielectric member mounted adjacent to the network having a region of relatively high permittivity and one or more transformer portions for reducing reflection of signals passing through the network. The dielectric member can be moved along the length of at least one of the feedlines to synchronously adjust the phase relationship between the common line and one or more of the ports. The dielectric member is formed with a second region having a space or region of relatively low permittivity, the second region overlapping the main junction.

A tenth aspect of the invention provides a method of manufacturing a dielectric phase shifter including the steps of forming a region of relatively low permittivity by removing material from an elongate dielectric member to form a space at an intermediate position along its length and filling the space with a solid material having a different permittivity relative to the removed material.

An eleventh aspect of the invention provides an elongate dielectric member formed with a space at an intermediate position along the length of the elongate member, the region of relatively low permittivity including a space filled with a solid material having a different permittivity relative to the removed material.

A twelfth aspect of the invention provides an elongate dielectric member having a first region of relatively low permittivity and at least one second region of relatively low permittivity adjacent to and spaced from an edge of the first region, where each region of relatively low permittivity is formed at an intermediate position along the length of the elongate dielectric member, the second region is relatively short compared to the first region, and each second region is positioned and dimensioned such that the second region acts as an impedance transformer.

The device can be used in a cellular base station panel antenna, or similar.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings. Several embodiments of the invention will now be described with reference to the accompanying drawings, in which:

DETAILED DESCRIPTION

In this written description, the use of the disjunctive is intended to include the conjunctive. The use of definite or indefinite articles is not intended to indicate cardinality. In particular, a reference to "the" object or thing or "an" object or "a" thing is intended to also describe a plurality of such objects or things.

The preferred arrangements described below provide a tuneable multi-channel phase shifter integrated with a beam-forming network for a linear antenna array. In order to control the beam direction and beam shape of this antenna array we need to provide certain phase relations between the radiating elements. For subsequent control and changing the beam direction these phase relations should be varied in a specific manner. The beam-forming network also includes circuit-matching elements to minimise signal reflection and maximise the emitted fields.

A 10-port feedline network with integrated phase shifter for a phased array antenna is shown in FIGS. 3 to 6. Conductor strips 1 to 18 form a feedline network (the dotted area in FIG. 3). These conductor strips can be fabricated from conducting sheets (e.g. brass or copper) or PCB laminate by for example etching, stamping, or laser cutting. It should be noted that, for the purposes of clarity, the width dimension of the device has been reduced by ⅓ of the length reduction in the representation of FIGS. 3*a*–3*c*. As a result the view of the feedline is somewhat distorted in places.

Figure 4:
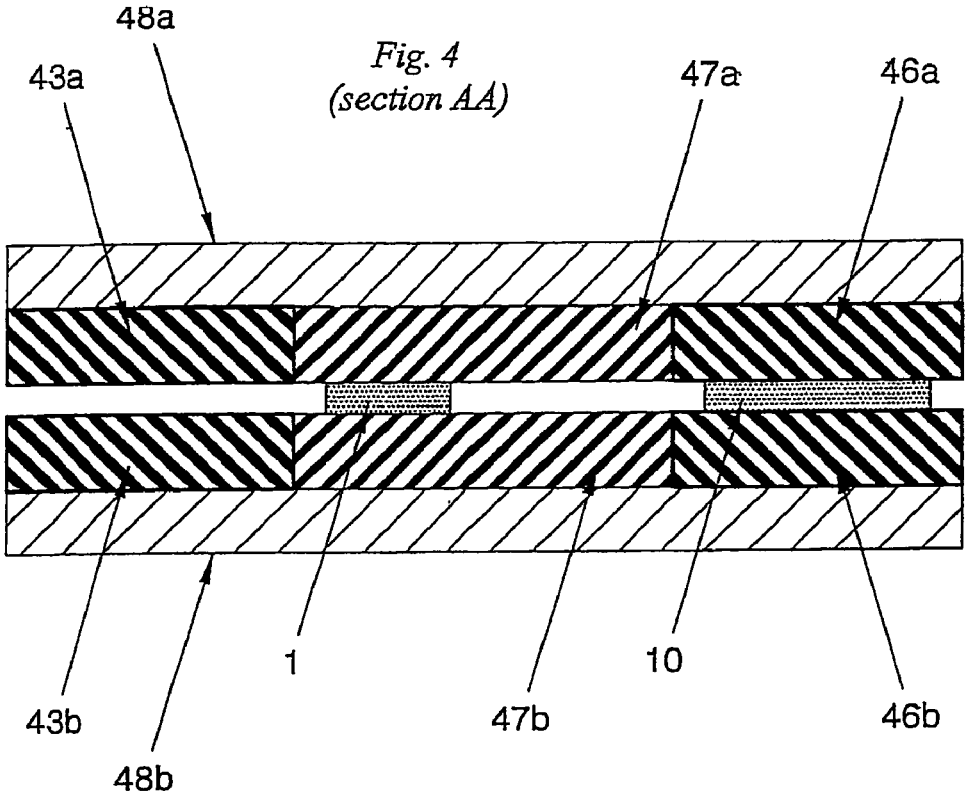
FIG. 4 is a cross-section taken along a line A—A in FIG. 3*a;*
Figure 5:
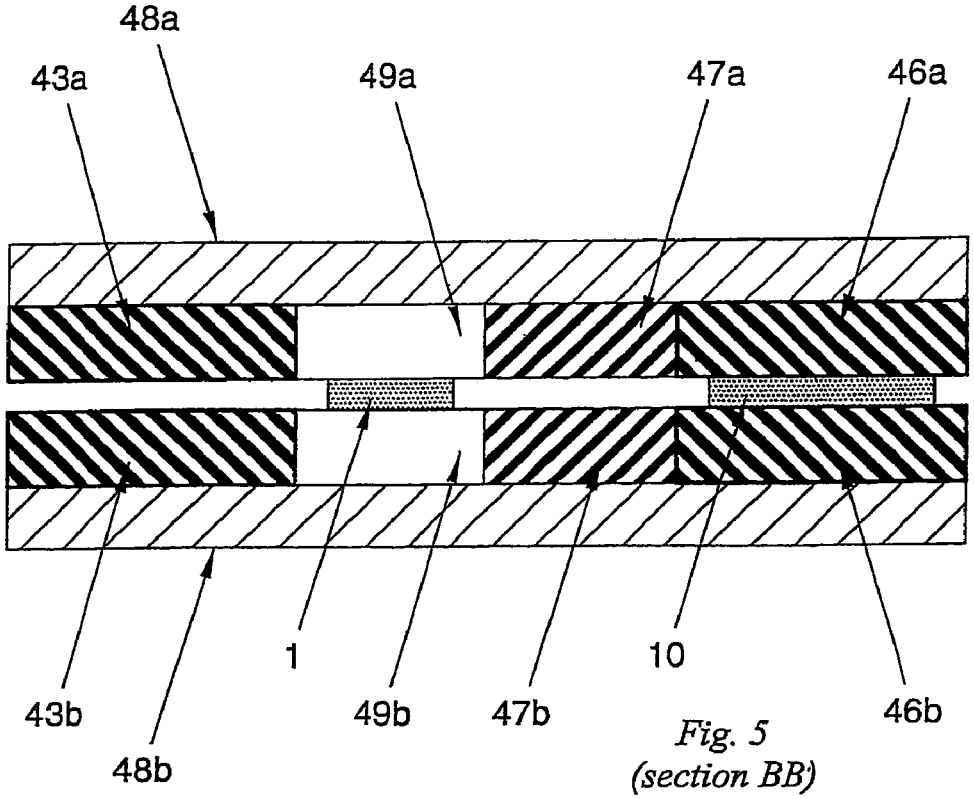
FIG. 5 is a cross-section taken along a line B—B in FIG. 3*b;*

As shown in FIGS. 4 and 5, the feedline network 1 to 18 is positioned between fixed dielectric blocks 43*a*, 43*b*, 46*a*, and 46*b*, and movable dielectric bars 47*a* and 47*b*. The whole assembly is enclosed in a conducting case, made of metal blocks 48*a* and 48*b*. The whole assembly forms a dielectric loaded strip-line arrangement.

The pair of sliding dielectric bars 47*a* and 47*b* is housed between the metal blocks 48*a* and 48*b*, in the space between the fixed dielectric blocks 43*a*, 43*b*, 46*a*, and 46*b*. For clarity the contour of the upper bar 47*a* is outlined by a bold line in the three plan views of FIG. 3. The bar 47*a* is shown in three different positions in FIGS. 3*a*, 3*b* and 3*c* . The lower bar 47*b* has an identical profile to the upper bar 47*a*. The bar profiles are formed by cutting portions of material from a single piece of dielectric material.

Figure 3A:
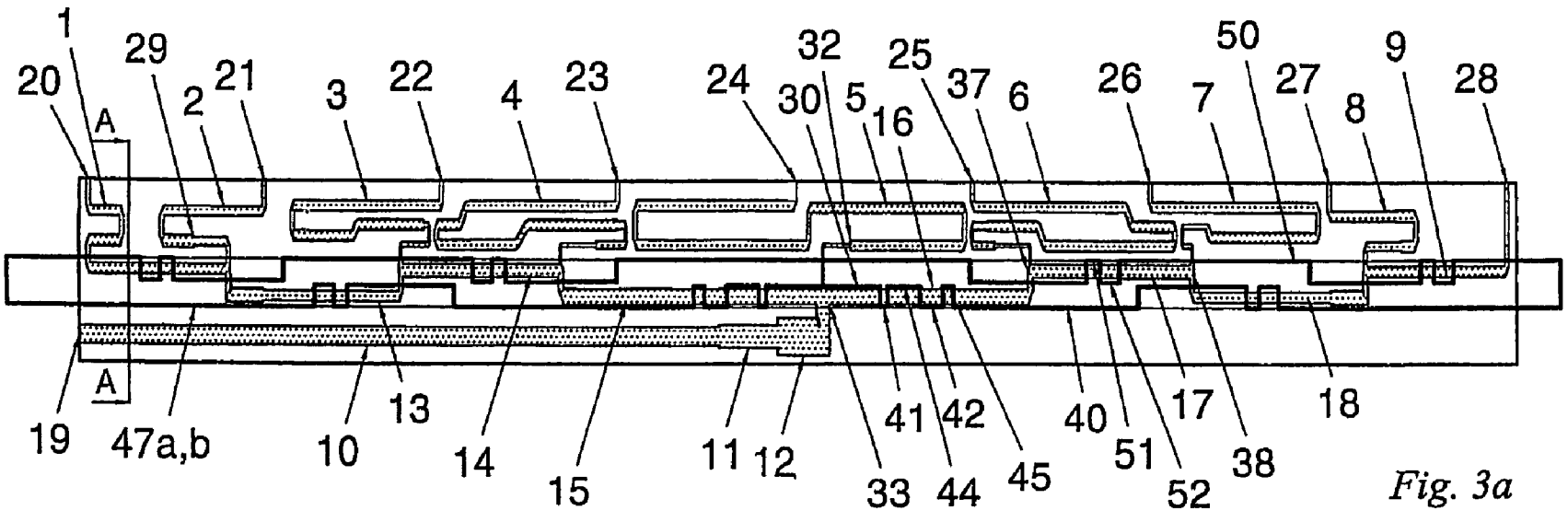
FIGS. 3*a* to 3*c* are three plan views (width reduced ⅓ of length reduction) of a 10-port device for an antenna beam-forming network with integrated tuneable multi-channel phase shifter, with the movable dielectric bars in three different positions.

FIG. 4 shows a cross section along line A—A in FIG. 3*a*, where the bars 47*a* and 47*b* have no off-cuts and entirely fill the space between the metal blocks 48*a*, 48*b* and the dielectric blocks 43*a*, 43*b*, 46*a*, and 46*b*. FIG. 5 shows a cross section taken along line B—B in FIG. 3*b*, where the bars 47*a* and 47*b* have off-cuts 49*a* and 49*b* and partially fill the space between the metal blocks 48*a*, 48*b* and the dielectric blocks 43*a*, 43*b*, 46*a*, and 46*b*. All off-cuts in the bars 47*a* and 47*b* have well defined locations and dimensions, which depend on the desired phase and power relations at ports 20 to 28. Simultaneously, the off-cuts serve as circuit-matching transformers for the feedline network.

The bars 47*a* and 47*b* can be continuously moved along their length to provide a desired phase shift. The movement of bars 47*a* and 47*b* provides simultaneous adjustment of the phase shift at all ports 20 to 28. The locations and dimensions of the off-cuts are chosen so that the movement of bars 47*a* and 47*b* within certain limits alters the phase relations between the ports 20–28 in a specified manner without changing the impedance matching at the input port 19.

To provide the desired division of power at each junction of the feedline network, circuit-matching transformers are integrated into the feedline network. An example of such circuit-matching elements is sections 11 and 12 near main junction 33 and section 29 in strip conductor 2. Here the circuit matching is achieved by varying the width of the feedline section. The length and width of these circuit-matching sections 11 and 12 is selected to minimise signal reflection at the main junction 33. In a preferred arrangement the sections 11 and 12 both have lengths of approximately $\lambda\backslash 4$ (where $\lambda$ is the wavelength in the feedline corresponding to the centre of the intended frequency band). These types of circuit-matching transformers will be referred to below as fixed transformers.

Figure 6:
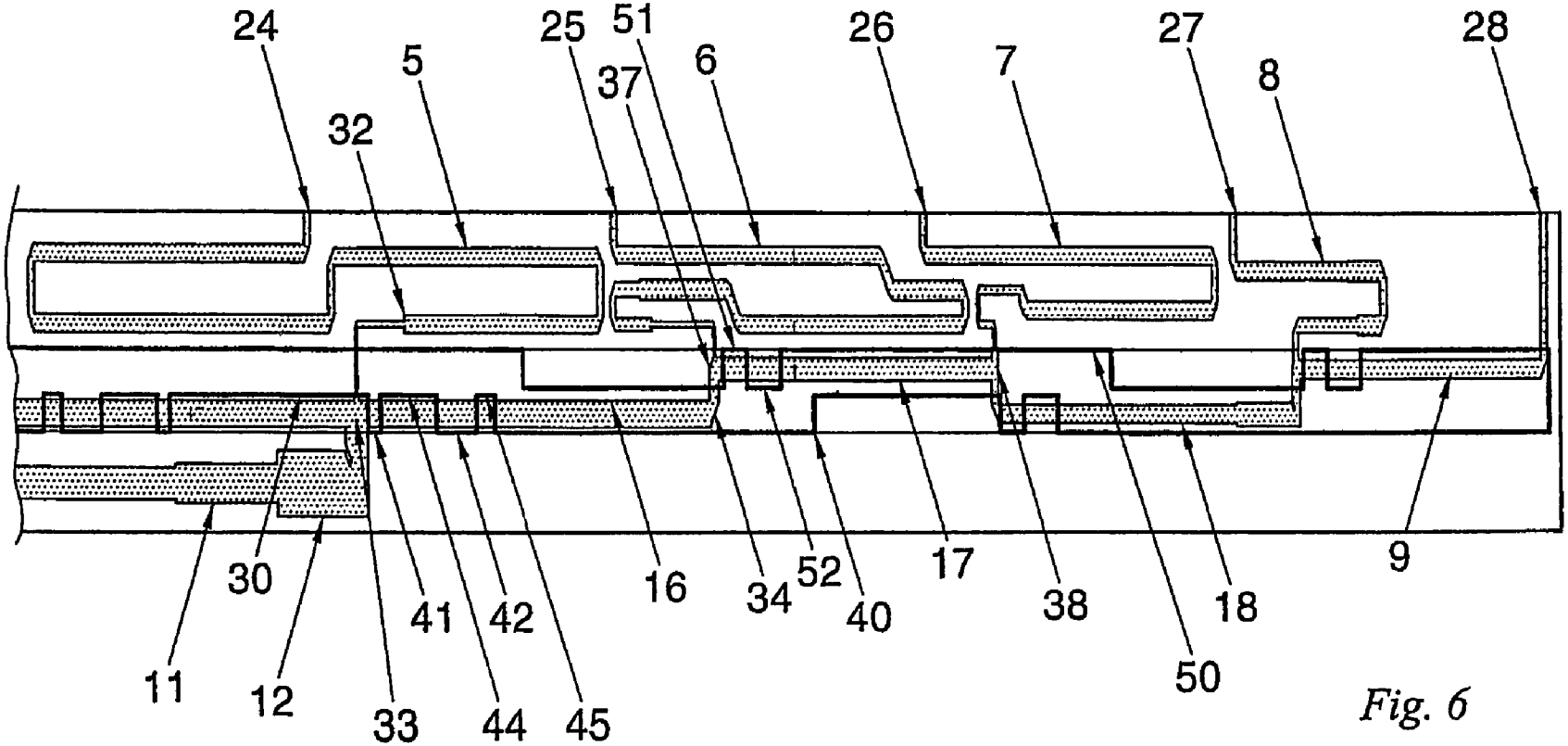
FIG. 6 is an enlarged plan view (width reduced ⅓ of length reduction) of the right hand side of the device of FIG. 3*b;*

Another example of a circuit-matching element in this device is shown in FIG. 6. Off-cut 52 and projection 51 on the moveable dielectric bar serve as an impedance matching transformer for the feedline segment 17 between junctions 37 and 38. This transformer matches the wave impedances between the part of stripline 17 where it crosses the left edge of projection 51, and the part of stripline 17 where it crosses the right edge of off-cut 52. This type of circuit-matching transformer will be referred to below as a moveable transformer. The length of the feedline between junction 38 and the right edge of off-cut 52 as well as the length of the feedline between junction 37 and the left edge of projection 51 vary with movement of the bars 47*a*, 47*b*. However the sum of the two lengths remains constant, regardless of the position of the bars 47*a* and 47*b* (within their working range), thus maintaining proper matching.

All of the movable and fixed transformers in the device decrease the wave impedance along the feedline network in the output direction. Therefore the steps in width-variation in the fixed transformers are smaller, and the lengths of the fixed transformers are shorter, when compared with a similar device having no moveable transformers. The reduced length of the fixed transformers enables greater movement of the moveable bars along a length of stripline with uniform width, thus allowing more phase shift. The smaller steps in width variation in the fixed transformers result in lower return loss.

An alternative type of moveable transformer is positioned between junctions 33 and 37 (FIG. 6). The transformer is similar to the moveable transformer between junctions 37 and 38, but in this case is formed by two projections 41, 42 and two off-cuts 44, 45.

Figure 7:
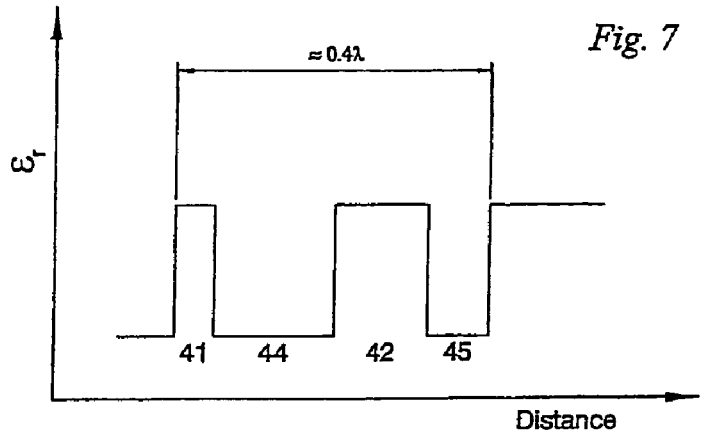
FIG. 7 is a graph showing the variation in permittivity $\in_r$, of the movable dielectric bars 47*a* and 47*b* taken along a portion of feedline 16.
Figure 8:
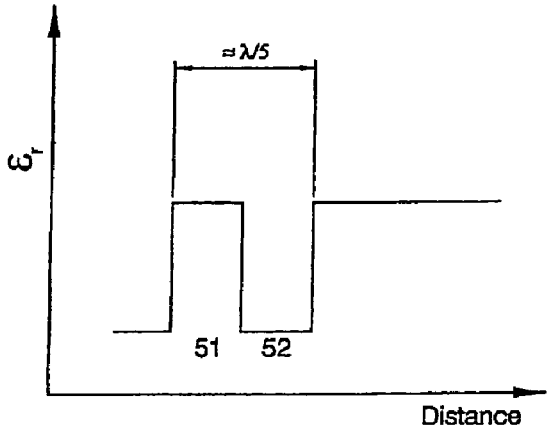
FIG. 8 is a graph showing the variation in permittivity $\in_r$ of the movable dielectric bars 47*a* and 47*b* taken along a portion of feedline 17.

The moveable transformers act as cascaded impedance transformers as shown in FIGS. 7 and 8 which illustrate variation of $\in_r$ along the feedlines adjacent to the cut-outs/projections 41, 42, 44, 45, 51 and 52.

The pattern of the strip conductors in FIG. 3 serves as a power distribution network for antenna radiating/receiving elements (not shown) connected to ports 20 to 28. The conductor pattern contains multiple splitters and circuit-matching elements. Thus the device can deliver an incoming signal from common port 19 to the ports 20 to 28 with specified phase and magnitude distribution (transmit mode). Also, the device can combine all incoming signals from ports 20 to 28 to the common port 19, with a predefined phase and amplitude relationship between the incoming signals (receive mode).

Figure 9:
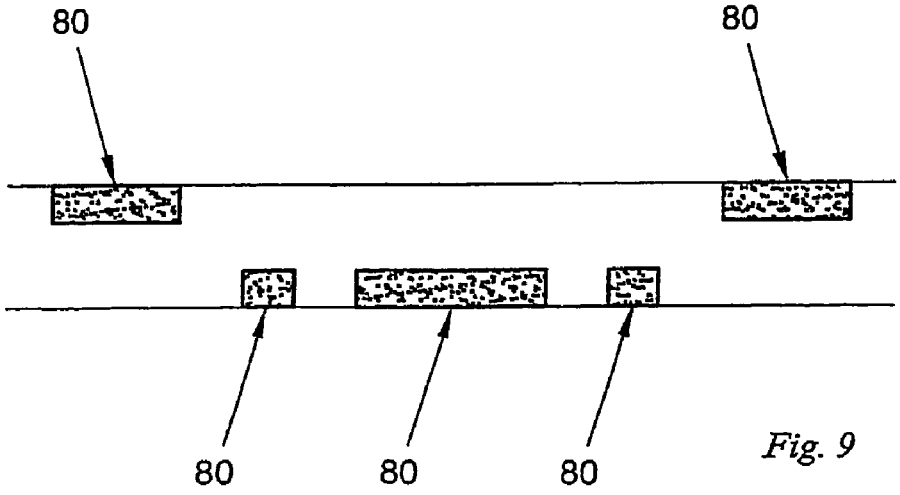
FIG. 9 is a schematic plan view of a segment of an alternative movable dielectric bar.

An alternative topology for the movable dielectric bars 47*a* and 47*b* is shown in FIG. 9. In FIG. 9, the off-cuts of the bars 47*a* and 47*b* are filled with a dielectric material 80 of different permittivity to the bar material, for instance polymethacrylimite.

A 5-port feedline network with an integrated multi-channel phase shifter for a phased array antenna is shown in FIGS. 10 to 13. The cross section is in principle is similar to the one for the 10-port device, as shown in FIGS. 4 and 5. However, in contrast to the layout of the 10-port device, input port 60 is positioned in line with output ports 61 to 64.

Conductor strips (shown as a dotted area in FIG. 10) form the conductor pattern of the feedline network. These conductor strips can be fabricated from conducting sheets (e.g. brass or copper) or PCB laminate by for example etching, stamping, or laser cutting. As shown in FIGS. 11 and 12, the feedline network is positioned between fixed dielectric blocks 67*a*, and 67*b*, and movable dielectric bars 68*a* and 68*b*. The whole assembly is enclosed in a conducting case, made of metal blocks 69*a* and 69*b*. The whole assembly forms a dielectric loaded strip-line arrangement. For clarity, the contour of the upper bar 68*a* is outlined by a bold line in the three plan views of FIG. 10. The bar 68*a* is shown in three different positions in FIGS. 10*a*, 10*b*, and 10*c*. The lower bar 68*b* has an identical profile to the upper bar 68*a*. The bar profiles are formed by removing portions of bar material, as shown in FIG. 13.

Figure 10A:
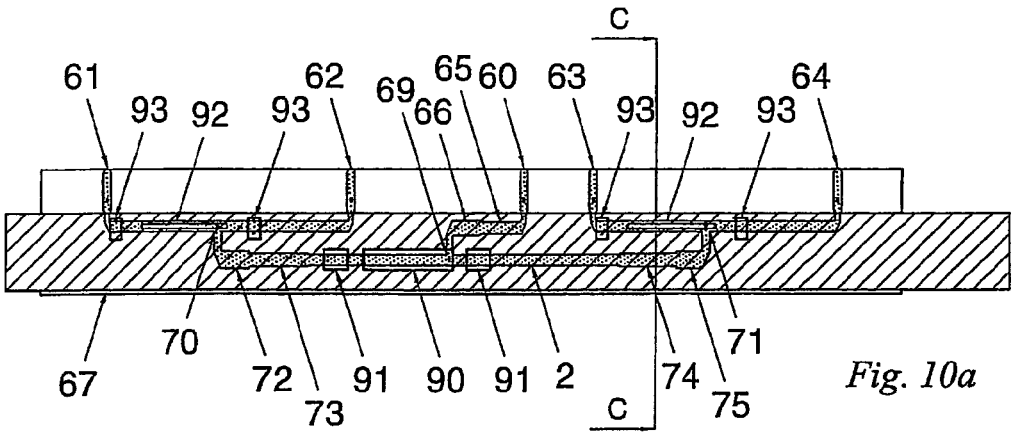
FIGS. 10*a* to 10*c* are three plan views (width reduced ½ of length reduction) of a 5-port device for an antenna beam-forming network with integrated tuneable multi-channel phase shifter, with the movable dielectric bars in three different positions.
Figure 11:
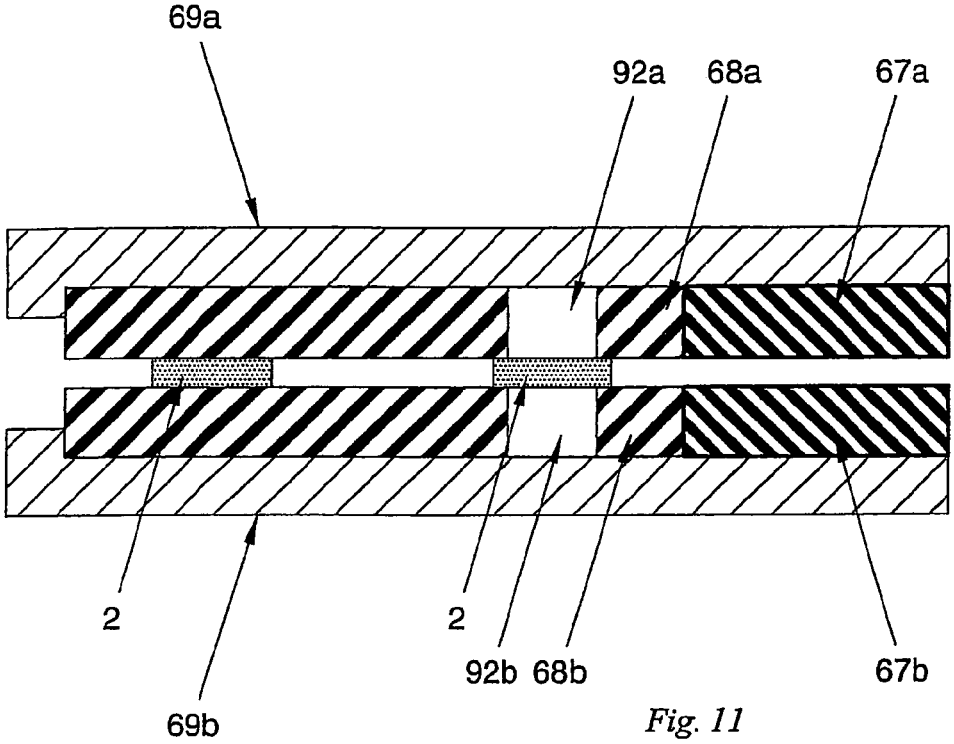
FIG. 11 is a cross-section taken along a line C—C in FIG. 10*a;*
Figure 12:
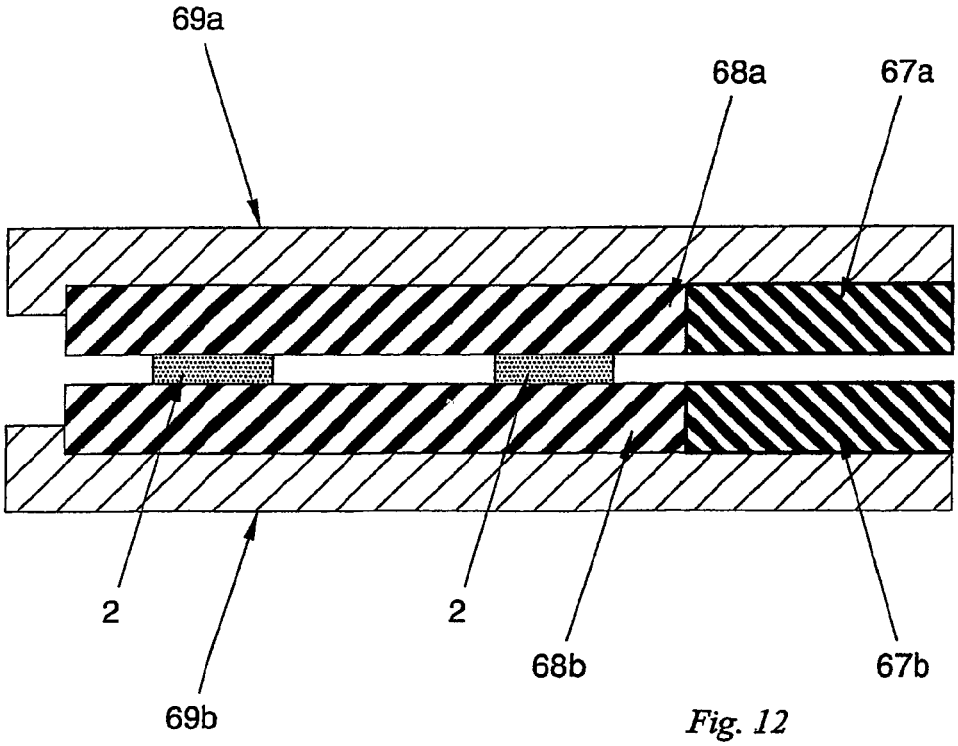
FIG. 12 is a cross-section taken along a line D—D in FIG. 10*c;*

FIG. 11 shows a cross section taken along line C—C in FIG. 10*a* where the moveable bars 68*a*, 68*b* have off-cuts 92*a*, 92*b* and partially fill the space between the metal blocks 69*b*, 69*b* next to fixed dielectric blocks 67*a*, 67*b*. FIG. 12 shows a device cross section taken along line D—D in FIG. 10*c* where the bars 68*a*, 68*b* have no off-cuts and entirely fill the space between the metal blocks 69*a*, 69*b* next to fixed dielectric blocks 67*a*, 67*b*. All off-cuts in the bars 68*a* and 68*b* have well defined locations and dimensions, which depend on the desired phase and power distribution at ports 61 to 64. Simultaneously, the off-cuts serve as matching transformers for the feedlines.

The bars 68*a* and 68*b* can be continuously moved along their length to provide a desired phase shift. The movement of bars 68*a* and 68*b* provides simultaneous adjustment of the phase shift at all ports 61 to 64. The locations and dimensions of the off-cuts are chosen so that the movement of bars 68*a* and 68*b* within certain limits alters the phase relations between the ports 61 to 64 in a specified manner and provides suitable matching at the input port 60.

Figure 13:
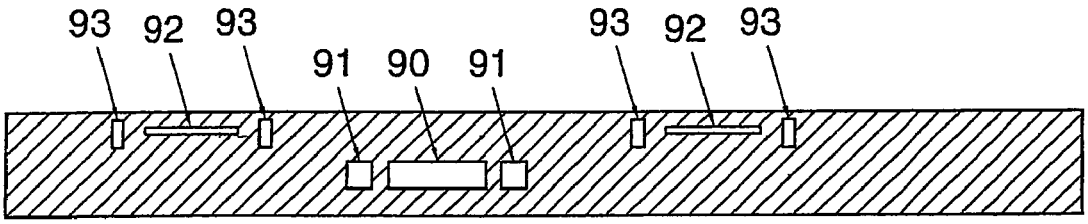
FIG. 13 is a schematic plan view (width reduced by ½ of length reduction) of the movable dielectric bar.

Alternatively, the off-cuts 90 to 93 shown in FIG. 13 could be filled with a dielectric material of different permittivity to the bar material. Alternative topologies for the bars 68*a* and 68*b* are described in the section with the 10-port device description.

To provide the desired division of power at each junction of the strip conductor, circuit-matching transformers are integrated into the distribution network formed by the strip conductors in FIG. 10. Examples of such fixed circuit-matching elements are sections 65 and 66 near junction 69, sections 72 and 73 near junction 70, and sections 74 and 75 near junction 71. Here the circuit matching is achieved by varying the dimensions of the feedline section. The length and width of these circuit-matching sections 65, 66 and 72 to 75 is selected to minimise signal reflection at the junctions 69 to 71. The off-cuts 90 to 93 in the dielectric bar 68*a* move only along a uniform portion of the feedline network.

The off-cuts 90 and 92 change the phase shift between outputs 61 to 64 when the dielectric bar 68*a* moves. The off-cuts 91 and 93 are the moveable transformers decreasing the wave impedance in the output direction from input 60 to outputs 61 to 64. In order to have equal wave impedances at the input and all four outputs, the transformers of the 5-port device must decrease the wave impedance along the paths from the input to each output 61 to 64 by a factor of ¼. The fixed and moveable transformers of the 5-port device shown in FIG. 10 facilitate this decrease in the following manner. The sections 65 and 66 decrease the wave impedance to ¾, the sections 72 and 73 to 10/16, the off-cuts 91 to ⅔, and the off-cuts 93 to ⅘ of the values at the beginning of each section.

Figure 14:
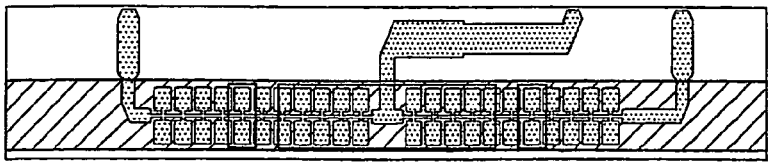
FIG. 14 is a schematic plan view of a 3-port device with a stripline formed with stubs.
Figure 15:
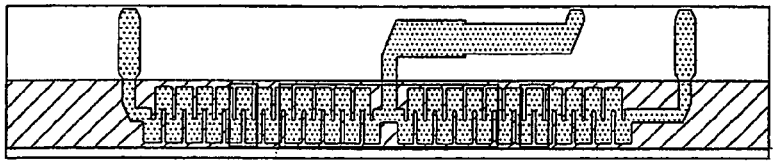
FIG. 15 is a schematic plan view of a 3-port device with a stripline formed as meander line.

It is possible to increase the phase shift per unit of bar-movement by changing the layout of the feedline network and creating a delay line. This delay line may be formed with short stubs (shown in FIG. 14) or arranged in a meander pattern (shown in FIG. 15). The arrangements shown in FIGS. 14 and 15 result in a non-linear dependence of phase shift and bar position, still suitable for antennas with variable downtilt.

Thus the proposed device provides a beam-forming network for an antenna array with electrically controllable radiation pattern, beam shape and direction. The new arrangement integrates the adjustable multi-channel phase shifter and power distribution circuitry into a single stripline package.

Figure 16:
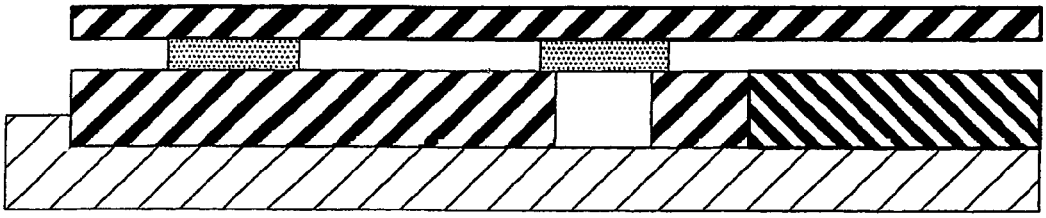
FIG. 16 is a cross section of a device as shown in FIG. 10 with an asymmetrical stripline arrangement.

The feedline network, as described above for the 5-port and 10-port device is symmetrical and contains two ground-planes 69*a* and 69*b* and two moveable dielectric bars 68*a* and 68*b*. It is possible to use a different arrangement containing one ground plane and one dielectric moveable bar, as shown in FIG. 16, to realise a multi-channel phase shifter. This non-symmetrical arrangement provides a simpler design, although it yields less phase shift and higher insertion loss than in a symmetrical arrangement.

Principles of Operation

The operation of the feedline network 2 of the 10-port device will now be described with reference to the transmit mode of the antenna. However it will be appreciated that the antenna may also work in receive mode, or simultaneously in transmit mode and receive mode.

Phase Relationships:

An input signal on common line 10 (FIG.3) propagates via impedance-matching transformers 11 and 12 to main junction 33. At main junction 33 the signal is split and it propagates via subsequent feedlines and a series of splitters to nine ports 20 to 28. Radiating elements (not shown) are connected, in use, to the nine ports 20 to 28. The amplitude and phase relationships between the signals at the nine ports 20 to 28 determine the beam shape and direction in which the beam is emitted by the antenna. The angle between the beam direction and horizon is conventionally known as the angle of 'downtilt'. The beam can be directed to the maximum 'downtilt' direction by creating the maximum phase shift ΔP between each pair of neighbouring ports.

Referring now to FIG. 6, feedline 5 leads from main junction 33 to central port 24. Feedline 5, branching off from splitter 33, is formed by folded lengths of stripline with an impedance matching step 32. Regardless of the position of the bars 47*a* and 47*b*, there is no change in permittivity along the path of the strip conductor between junction 33 and port 24 (as can be seen in FIGS. 3*a, b* and *c*). Therefore, the electrical length of the feedline between main junction 33 and central port 24 remains constant at all positions of the dielectric bars.

Figure 3B:
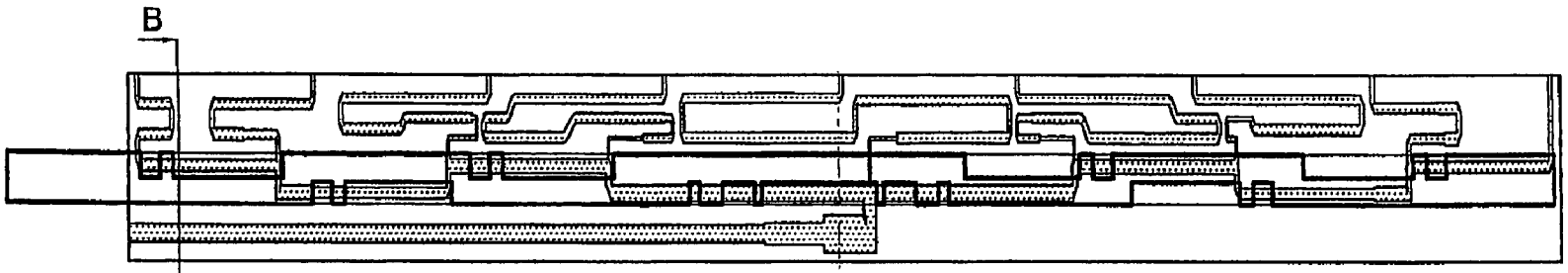
Figure 3C:
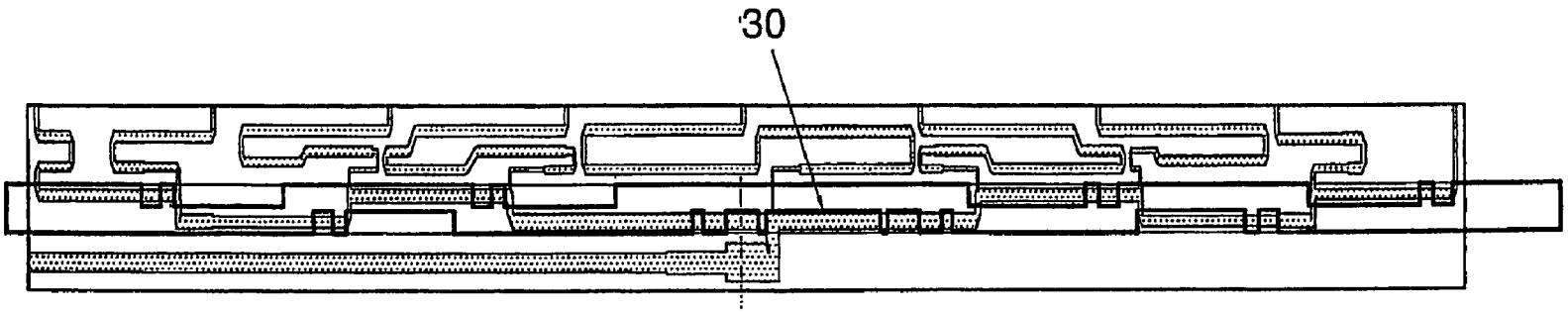

The dimensions of this device are chosen in a way that with the bars 47*a* and 47*b* set in the extreme left position shown in FIG. 3*b*, the ports 20 to 28 are in phase (that is, ΔP is zero). Moving the bars 47*a* and 47*b* to the right simultaneously changes the electrical length of certain parts of the feed network between the bars 47*a* and 47*b*. For feedline 16 between junctions 33 and 37 in FIG. 6, moving the bars 47*a* and 47*b* to the right decreases the length of feedline 16 covered by projection 40 and simultaneously increases the open length of feedline 16 between main junction 33 and the left edge of projection 41. With the permittivity $\in_r$ of the projections being higher than the permittivity of the off-cuts, as shown in FIG. 7, moving bars 47*a* and 47*b* to the right will therefore decrease the length feedline 16 with higher $\in_r$ and increase the length with lower $\in_r$. As a result this will decrease the phase difference ΔP between junctions 33 and 37.

For the feedline 17 between junctions 37 and 38, moving the bars 47*a* and 47*b* to the right decreases the length of this feedline covered by projection 50, and simultaneously increases the length of this feedline between junction 37 and the left edge of projection 51.

The dimensions of the device are also chosen so that regardless of the positions of bars 47*a* and 47*b* (within their working range) there is a phase shift ΔP/2 between each pair of neighbouring ports. With the bars in the middle position (FIG. 3*a*) the phase shift relative to port 24 is −2*ΔP degree at left-hand port 20, and +2*ΔP degree at right-hand port 28. With the bars in the extreme right position (FIG. 3*c*) the phase shifts relative to port 24 are −4*ΔP degree at left-hand port 20, and +4*ΔP degree at right-hand port 28.

The amount of phase shift ΔP is determined by the permittivity of the material used for bars 47*a* and 47*b*, and the off-cut shape. The permittivity of the dielectric materials used affects the phase velocity of the signals travelling in the feedline network. Specifically, the higher the permittivity, the lower the phase velocity or longer the electrical length of transmission line. Thus, by varying the length of dielectric bar sections that overlap (as viewed from the perspective of FIG. 3) the strip conductors of the feedlines, it is possible to control the phase shift between the signal at the ports 20 to 28. A dielectric material "Styrene" or polypropylene is used for fabricating the moveable dielectric bars 47*a*, 47*b*.

The layout of the feedline network, and the locations and sizes of the off-cuts in bars 47*a* and 47*b* can be altered to obtain different phase relationships between the ports 20 to 28.

The operation of the feedline network 2 of the 5-port device will now be described with reference to the transmit mode of the antenna. However it will be appreciated that the antenna may also work in receive mode, or simultaneously in transmit mode and receive mode.

An input signal on feedline 60 (FIG. 10) propagates via impedance-matching transformers 65 and 66 to a junction 69. From the junction 69 the signal is fed via junction 70 to ports 61 and 62, and via junction 71 to ports 63 and 64. Radiating elements (not shown) are connected, in use, to the four ports 61 to 64. The phase relationship between the signals at the four ports 61 to 64 determines the beam shape and direction in which the beam is emitted by the antenna.

The position of the dielectric bars 68*a* and 68*b* controls the phase relationship between the ports 61 to 64. The following refers to a device with the off cuts of bars 68*a* and 68*b* shaped as shown in FIGS. 10 and 13. The location and size of the off-cuts is chosen to obtain phase relationships as described below.

Figure 10B:
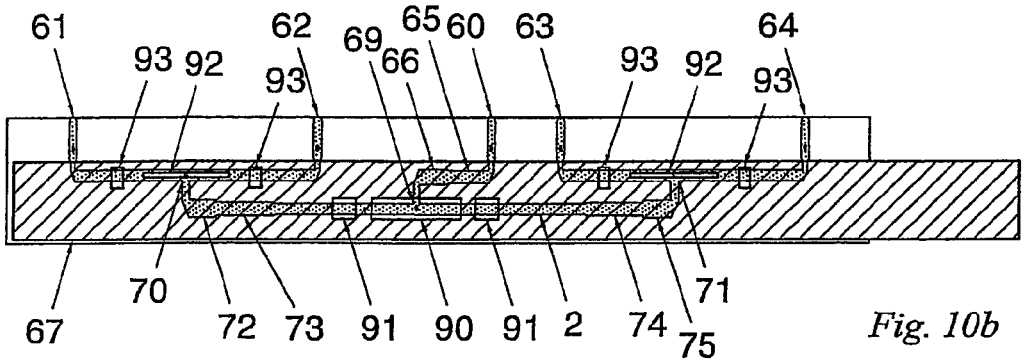
Figure 10C:
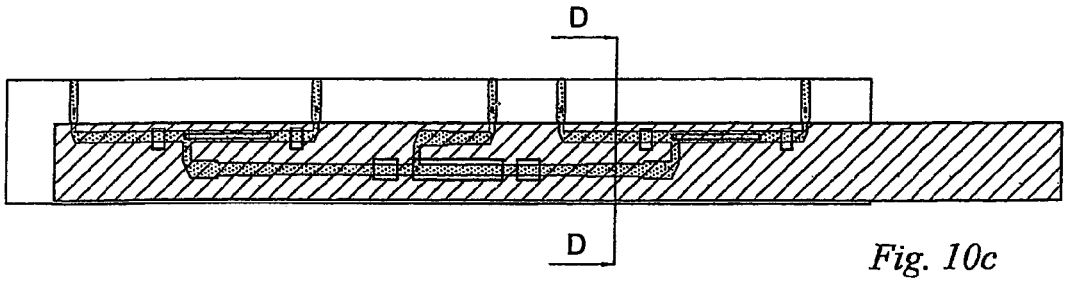

With the bars 68*a* and 68*b* set in the middle position, shown in FIG. 10*b*, the ports 61 to 64 have specified phase relationships. Moving for example the bars 68*a* and 68*b* to the left changes simultaneously the electrical length of certain parts of the feedline network between the bars 68*a* and 68*b*. For example, when moving bars 68*a* and 68*b* from the middle position (FIG. 10*b*) to the extreme left (FIG. 10*a*) the length of the feedline between junction 69 and the left edge of off-cut 90 increases, and the length of the feedline between the left edge of 91 and junction 70 decreases simultaneously. The off-cuts 92 have a smaller width than off-cut 90 to change the variable phase shift between outputs 61 and 62 by only half the amount than between outputs 61 and 63. With the moving bars 68*a* and 68*b* at the extreme left position (FIG. 10*a*) the phase shift relative to port 61 is −ΔP at port 62, −2*ΔP at port 63 and −3*ΔP at port 64.

Figure 2:
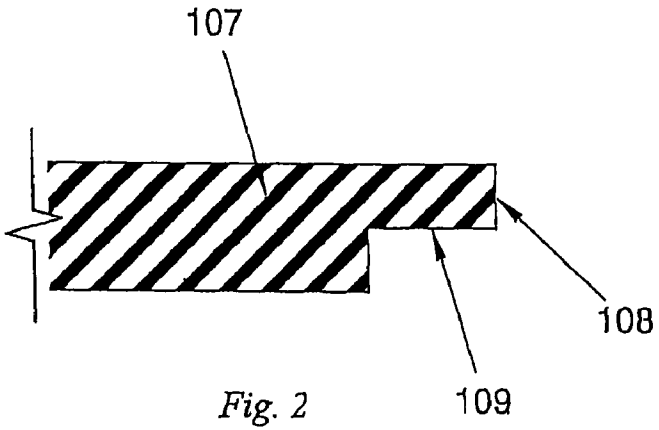
Fig. 2 Prior Art
FIG. 2 is side view of the edge of the prior art device shown in FIG. 1.
Figure 1:
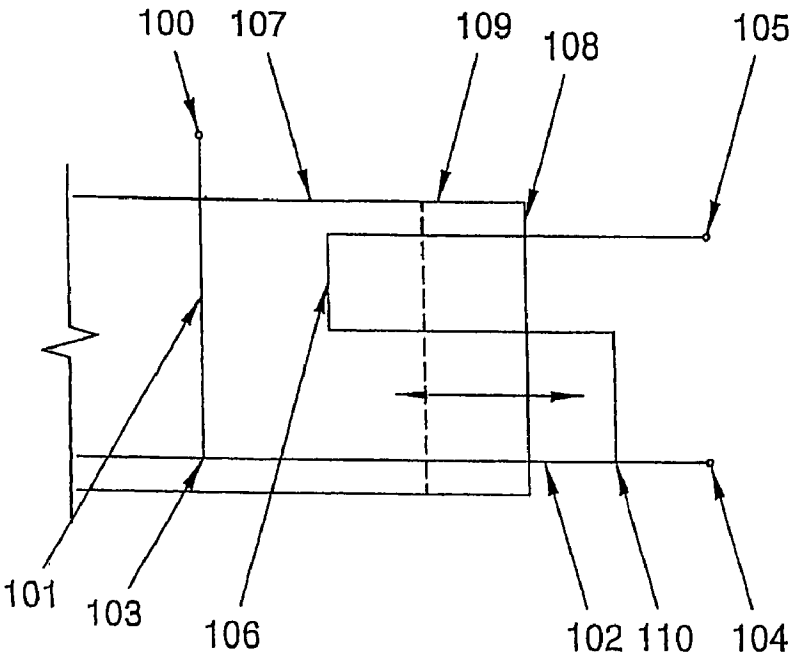
FIG. 1 is a schematic plan view of a prior art device.

The amount of phase shift ΔP is determined by the permittivity of the material used for bars 68*a* and 68*b*, and the off-cut shape. The permittivity of dielectric materials used affects the phase velocity of the signals travelling in the feedline network. Specifically, the higher the permittivity, the lower the phase velocity or longer electrical length of transmission line. Thus, by varying the length of dielectric bar sections that overlap (as viewed from the perspective of FIG. 1) the strip conductors of the feedlines, it is possible to control the phase shift between the signal at the ports 20 to 28. A dielectric material "Styrene" is used for fabricating moveable dielectric bars 68*a* and 68*b*.

The offcuts in the dielectric bars may be removed by a stamping operation, or by directing a narrow high pressure stream of fluid onto the material to be removed.

Specific embodiments of an adjustable antenna feed network with integrated phase shifter according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

The invention claimed is:

1. A device for feeding signals between a common line and two or more ports, the device including a branched network of feedlines coupling the common line with the ports via one or more junctions, said one or more junctions including a main junction which includes the common line; and a dielectric member mounted adjacent to the network, the dielectric member having a region of relatively high permittivity and one or more transformer portions for reducing reflection of signals passing through the network; wherein the dielectric member can be moved along the length of at least one of the feedlines to synchronously adjust the phase relationship between the common line and one more of the ports, and wherein the dielectric member is formed with a second region comprising a space or region of relatively low permittivity, the second region overlapping the main junction.

2. The device of claim 1 wherein at least one of the feedlines has a transformer portion of varying width for reducing reflection of signals passing through the network.

3. The device of claim 2 wherein the feedline transformer portion includes a step change in the width of the feedline.

4. A device according to claim 1 wherein the second region is a space which overlaps with the main junction.

5. The device of claim 4 wherein the second region is formed in a side of the dielectric member.

6. The device of claim 4 wherein the second region is formed in the interior of the dielectric member.

7. The device of claim 1 wherein the dielectric member is formed with an impedance transformer adjacent to the main junction.

8. The device of claim 1 including a first ground plane positioned on one side of the network.

9. The device of claim 8 including a second ground plane positioned on an opposite side of the network.

10. The device of claim 1 wherein the feedlines are strip feedlines.

11. The device of claim 1 wherein the dielectric member is formed as a unitary piece.

12. The device of claim 1 wherein the dielectric member is elongate and movable along its length in a direction parallel to an adjacent feedline.

13. The device of claim 1, wherein the device has three or more ports which are arranged along a substantially straight line.

14. The device of claim 1 wherein at least one of the feedlines is formed with a delay structure, which increases the electrical length of the feedline.

15. The device of claim 14 wherein the delay structure comprises one or more meanders.

16. The device of claim 15 wherein the meanders have a meander-period less than a wavelength of the signals to be carried by the network.

17. The device of claim 15 wherein the delay structure comprises a plurality of stubs.

18. The device of claim 1, wherein the branched network has two or more junctions.

19. The device of claim 1, wherein the branched network has at least one transformer portion of varying width for reducing reflection of signals passing through the network, wherein the transformer portion is positioned between an antenna port and a junction of the branched network.

20. An antenna including a device according to claim 1, and two or more antenna elements coupled to the device.

21. A device for feeding signals between a common line and two or more ports, the device including a branched network of feedlines coupling the common lines with the ports; and a dielectric member mounted adjacent to the network which can be moved to adjust the phase relationship between the common line and one or more of the ports, wherein the dielectric member is formed with a first space or region of relatively low permittivity, and at least one second space or region of relatively low permittivity adjacent to and spaced from an edge to the first space or region, wherein the or each second space or region is relatively short compared to the first space or region in the direction of movement of the dielectric member, and wherein the position and size of the or each second space or region are selected such that the or each second space or region acts as an impedance transformer.

22. The device of claim 21 wherein the first and/or second space or region is formed in a side of the dielectric member.

23. The device of claim 21 wherein the first and/or second space or region is formed in the interior of the dielectric member.

24. A method of manufacturing a dielectric phase shifter, the method including the steps of forming a region of relatively low permittivity by removing material from an elongate dielectric member to form a space at an intermediate position along its length; and filling the space with a solid material having a different permittivity relative to the removed material.

25. A method according to claim 24 wherein the space is an open space.

26. A method according to claim 24 wherein the space is a closed space formed in an interior of the dielectric member.

27. A method according to claim 24 further including mounting the dielectric member adjacent to the feedline with its length aligned with the feedline, whereby the dielectric member can be moved along the length of the feedline to adjust a degree of overlap between the feedline and the dielectric member.

28. A dielectric phase shifter formed by the method of claim 24.

29. A method of manufacturing a dielectric phase shifter, the method including the steps of forming a first region of relatively low permittivity and forming at least one second region of relatively low permittivity adjacent to and spaced from an edge of the first region, each region of relatively low permittivity being formed by removing material from an elongate dielectric member to form a space; wherein each region of relatively low permittivity is formed at an intermediate position along the length of the elongate dielectric member;

the or each second region is relatively short compared to the first region; and the each second region is positioned and dimensioned such that the second region acts as an impedance transformer.

30. An elongate dielectric member having a first region of relatively low permittivity and at least one second region of relatively low permittivity adjacent to and spaced from an edge of the first region, wherein each region of relatively low permittivity is formed at an intermediate position along the length of the elongate dielectric member;

the or each second region is relatively short compared to the first region; and the or each second region is positioned and dimensioned such that the second region acts as an impedance transformer.

* * * * *